US008646602B2

(12) United States Patent
Wang

(10) Patent No.: US 8,646,602 B2
(45) Date of Patent: Feb. 11, 2014

(54) DISPLAYABLE TOOL RECEIVING DEVICE

(76) Inventor: Tzu-Chien Wang, Tainan (TW)

( * ) Notice: Subject to any disclaimer, the term of this patent is extended or adjusted under 35 U.S.C. 154(b) by 143 days.

(21) Appl. No.: 13/274,260

(22) Filed: Oct. 14, 2011

(65) Prior Publication Data

US 2013/0092809 A1 Apr. 18, 2013

(51) Int. Cl.
*B65D 85/28* (2006.01)

(52) U.S. Cl.
USPC ..... 206/377; 206/372; 206/806; 206/779

(58) Field of Classification Search
USPC ..... 206/372–379, 234, 576, 349, 779, 806; 211/70.6, 69; 248/317, 314
See application file for complete search history.

(56) References Cited

U.S. PATENT DOCUMENTS

| | | | | |
|---|---|---|---|---|
| 4,467,925 | A * | 8/1984 | Ratzloff et al. | 211/70.6 |
| 5,645,177 | A * | 7/1997 | Lin | 211/70.6 |
| 5,862,913 | A * | 1/1999 | Chou | 206/378 |
| 6,044,985 | A * | 4/2000 | Kao | 211/70.6 |
| 6,076,669 | A * | 6/2000 | Ling | 206/349 |
| 6,415,933 | B1 * | 7/2002 | Kao | 211/70.6 |
| 6,450,338 | B1 * | 9/2002 | Chen | 206/378 |
| 6,615,983 | B1 * | 9/2003 | Yu | 206/372 |
| 7,198,158 | B2 * | 4/2007 | Kao | 211/70.6 |
| 7,258,239 | B2 * | 8/2007 | Kao | 211/70.6 |
| 7,331,455 | B2 * | 2/2008 | Lin | 206/378 |
| 7,591,385 | B2 * | 9/2009 | Brooks | 211/94.01 |
| 7,717,278 | B2 * | 5/2010 | Kao | 211/70.6 |
| 7,753,216 | B2 * | 7/2010 | Kao | 211/70.6 |
| 8,069,984 | B2 * | 12/2011 | Larson et al. | 206/377 |
| 8,261,912 | B1 * | 9/2012 | Ingrey-Senn | 206/378 |
| 2006/0254940 | A1 * | 11/2006 | Mu et al. | 206/378 |
| 2008/0185305 | A1 * | 8/2008 | Roesler | 206/349 |
| 2011/0005954 | A1 * | 1/2011 | Zhang | 206/375 |

* cited by examiner

*Primary Examiner* — Steven A. Reynolds
*Assistant Examiner* — James Way

(57) ABSTRACT

A displayable tool receiving device includes a hanger body having a hanger hole. The hanger body further includes a rectilinear first coupling portion and a plurality of spaced first positioning portions. The displayable tool receiving device further includes a plurality of tool receiving boxes each including a rear side having a rectilinear second coupling portion. The rear side of each tool receiving box further includes a second positioning portion. At least one of the tool receiving boxes is optionally mounted to the hanger body. The second coupling portion of each of the at least one of the plurality of tool receiving boxes is engaged with the first coupling portion of the hanger body. The second positioning portion of each of the at least one of the tool receiving boxes is engaged with one of the first positioning portions of the hanger body.

9 Claims, 10 Drawing Sheets

DISPLAYABLE TOOL RECEIVING DEVICE

BACKGROUND OF THE INVENTION

The present invention relates to a tool receiving device and, more particularly, to a displayable tool receiving device including a plurality of modular tool receiving boxes releasably mounted to a hanger body to provide enhanced assembly, display, and convenient storage of tools.

Tools, such as screwdrivers and sockets, include many types and sizes. Taking screwdrivers as an example, screwdriver bits of various types and sizes can be releasably coupled with a common handle for driving various screws. Furthermore, the handle can be coupled with differing adapters for differing sockets or screwdriver bits.

Conventionally, the screwdriver bits, the adapters, and other tool parts are received in a toolbox that can not be displayed by hanging. A typical hanging type tool receiving device that can display tools includes a board having a hanging hole. The board includes retaining rings, insertion holes or the like to retain tools. However, the tools are liable to swing and even disengage from the board. Furthermore, the tools that can be displayed are limited by the type and size of the retaining rings or insertion holes.

BRIEF SUMMARY OF THE INVENTION

An objective of the present invention is to provide a tool receiving device including a plurality of modular tool receiving boxes releasably mounted to a hanger body to provide enhanced assembly, display, and convenient storage of tools.

A displayable tool receiving device according to the present invention includes a hanger body having a hanger hole. The hanger body further includes a rectilinear first coupling portion and a plurality of spaced first positioning portions. The displayable tool receiving device further includes a plurality of tool receiving boxes each including a rear side having a rectilinear second coupling portion. The rear side of each of the plurality of tool receiving boxes further includes a second positioning portion. At least one of the plurality of tool receiving boxes is optionally mounted to the hanger body. The second coupling portion of each of the at least one of the plurality of tool receiving boxes is engaged with the first coupling portion of the hanger body. The second positioning portion of each of the at least one of the plurality of tool receiving boxes is engaged with one of the plurality of first positioning portions of the hanger body.

In a form shown, the hanger body includes a front surface and a rear surface, and the first coupling portion is provided on each of the front and rear surfaces of the hanger body. The first coupling portion on each of the front and rear surfaces of the hanger body is a rectilinear rib including upper and rear faces each having a concave retaining groove. The first positioning portions are protrusions, with some of the protrusions located above the first coupling portion, and with a remaining of the protrusions located below the first coupling portion. The second coupling portion of each of the plurality of tool receiving boxes is a rectilinear engagement groove having a width corresponding to a width of the concave retaining groove. Each of the engagement grooves includes upper and lower retaining edges. The upper and lower retaining edges of each of the at least one of the plurality of tool receiving boxes are engaged with the concave retaining grooves of the rib on one of the front and rear surfaces of the hanger body. The second positioning portion of each of the plurality of tool receiving boxes is a positioning groove. The positioning groove of each of the at least one of the plurality of tool receiving boxes is engaged with one of the protrusions of the hanger body. The plurality of tool receiving boxes include a bit receiving box and an adapter receiving box/ The bit receiving box is adapted to receive a screwdriver bit, and the adapter receiving box is adapted to receive an adapter.

In a form shown, the bit receiving box includes a rear board, two side boards, a bottom board, and a bit receiving section. The second coupling portion is located on the rear board. The two side boards extend perpendicularly from two lateral edges of the rear board. The two side boards and the rear board define a compartment. Each of the two side boards includes a front end and a top end. A first snapping portion is provided on a rear end of an inner wall of each of the two side boards. The bottom board is connected to a lower end of the rear board and to a lower end of each of the two side boards. The bottom board includes a front end connected to a bottom edge of the bit receiving section. The bit receiving section is pivotable relative to the bottom board between a storage position received in the compartment and a display position outside of the compartment. The bit receiving section includes a front board, a top board, and a clamping section. The front board has a width substantially equal to a spacing between the front ends of the two side boards. The front board covers a front opening defined between the front ends of the two side boards when the bit receiving section in the storage position. The top board extends perpendicularly to a top end of the front board and has a width corresponding to a spacing between top ends of the two side boards. The top board covers the top ends of the two side boards when the bit receiving section is in the storage position. The top board includes a second snapping portion on a rear end thereof. The second snapping portion is engaged with the first snapping portion when the bit receiving section is in the storage position. The clamping section extends from an inner wall of the top board and includes two flexible clamping pieces. The two flexible clamping pieces define a clamping space. The bit is adapted to be held in the clamping space.

Preferably, the first snapping portion on the rear end of the inner wall of each of the two side boards is a ridge. A snapping groove is defined between each of the ridges and the rear board. The second snapping portion includes two lugs releasably engaged in the snapping grooves. Each of the two lugs includes a recessed portion to provide a space for deformation of the lug.

Preferably, the front end of the bottom board is connected to the bottom edge of the bit receiving section by a thin connecting section. The thin connecting section allows the bottom board to pivot relative to the bit receiving section. A gripping section is formed on a top face of the top board.

In a form shown, the adapter includes an operative first end and a second end. The second end of the adapter includes an annular groove. The adapter receiving box includes a rear plate, two side plates, and an adapter receiving section. The second coupling portion is located on the rear plate. The rear plate includes an inner wall having a protrusion. The two side plates extend perpendicularly from two lateral edges of the rear plate. A first snapping section is formed on a lower end of an inner wall of each of the two side plates. The adapter receiving section is pivotable relative to the rear plate between a storage position and a display position. The adapter receiving section includes a top plate, a front plate, and a clamping portion. The front plate extends perpendicularly from a front end of the top plate. The front plate includes a width corresponding to a spacing between front ends of the two side plates. The front plate covers a front opening defined between the front ends of the two side plates when the adapter receiving section is in the storage position. Two fence plates extend perpendicularly from two lateral edge of the front plate. A second snapping section is formed on each of the two fence plates. The clamping portion includes two flexible clamping pieces located between the two fence plates and defining a clamping space. The adapter is adapted to be held in the clamping space. When the adapter receiving section is in the storage position, the adapter receiving section is received in a space defined by the two side plates and the rear plate, the second snapping sections of the two fence plates are engaged with the first snapping sections of the two side plates, and the annular groove of the adapter receives the protrusion of the rear plate.

Preferably, the rear plate of the adapter receiving box includes an inner wall having a projection adapted to abut the second end of the adapter. Each of the first snapping sections includes a snapping groove. Each of the second snapping sections includes a bulge releasably engaged with the snapping groove of one of the first snapping sections.

Preferably, a rear end of the top plate of the adapter receiving box is connected by a thin connecting section to a top end of the rear plate.

The present invention will become clearer in light of the following detailed description of illustrative embodiments of this invention described in connection with the drawings.

DETAILED DESCRIPTION OF THE INVENTION

Figure 1:
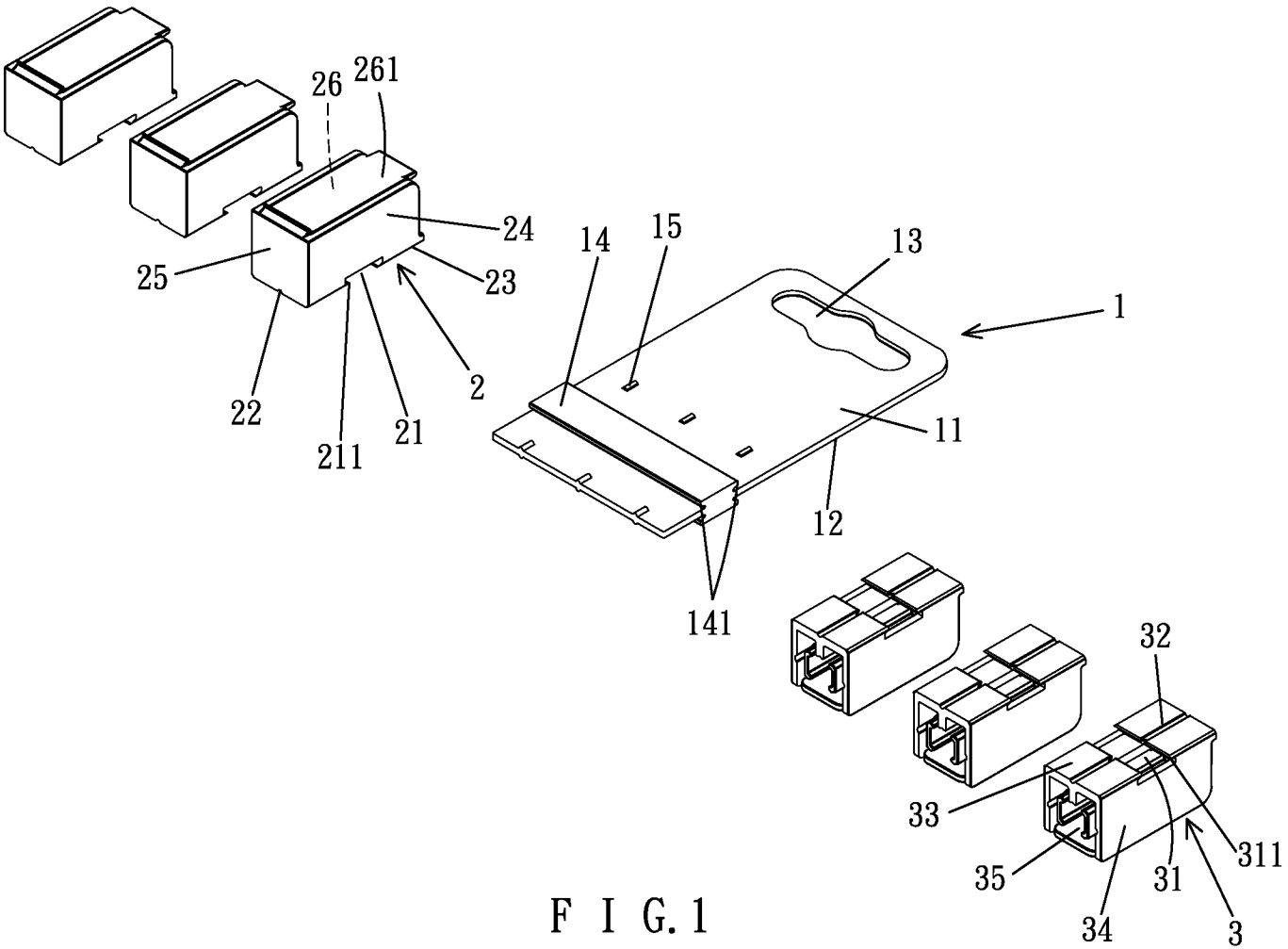
FIG. 1 shows an exploded, perspective view of a displayable tool receiving device according to the present invention.
Figure 2:
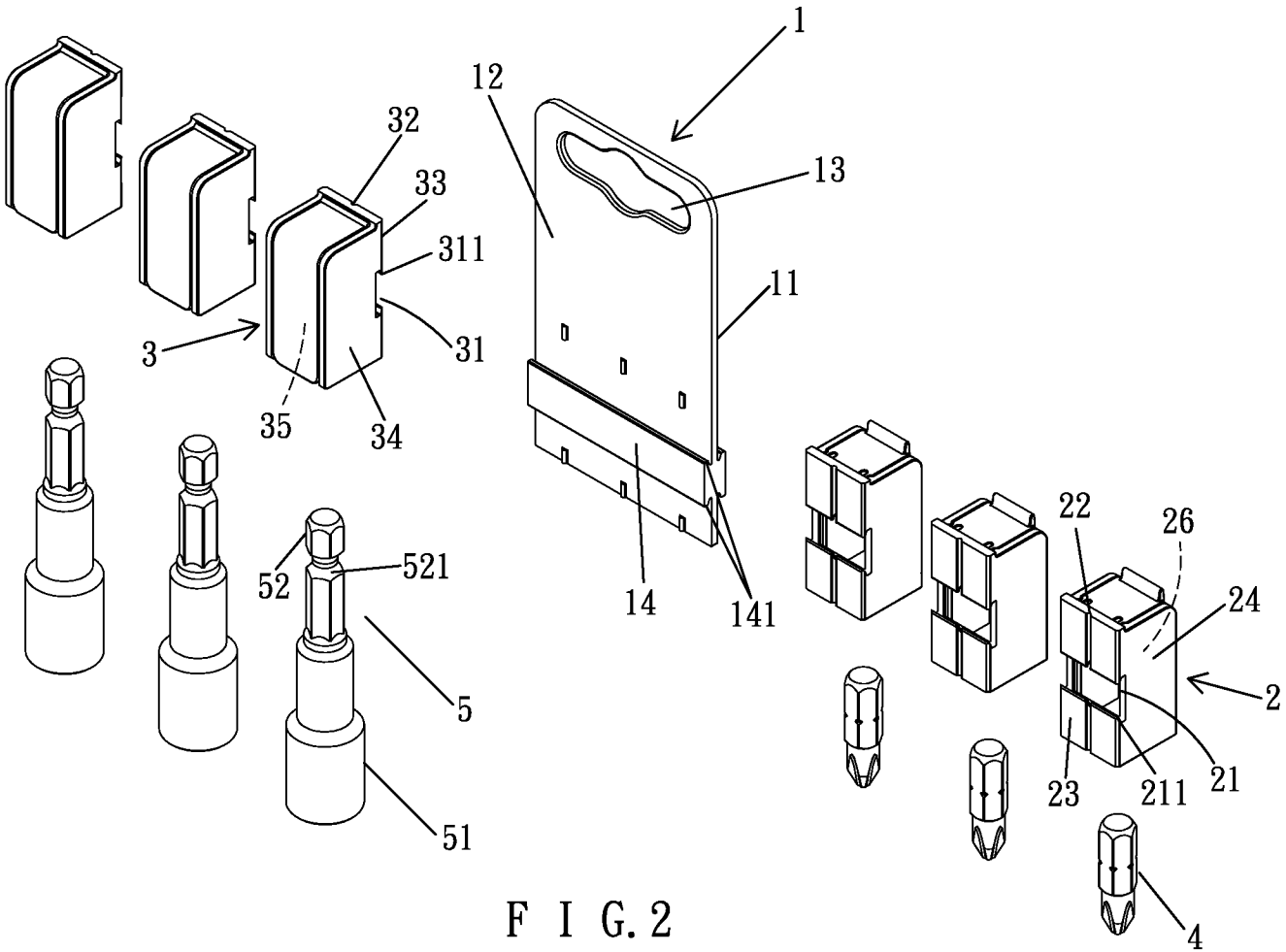
FIG. 2 shows another exploded, perspective view of the tool receiving device of FIG. 1 and tools received in the tool receiving device.

With reference to FIGS. 1 and 2, a displayable tool receiving device according to the present invention includes a hanger body 1 having front and rear surfaces 11 and 12. A hanger hole 13 is formed in an upper end of the hanger body 1. A rectilinear first coupling portion 14 is formed on each of the front and rear surfaces 11 and 12 of the hanger body 1. In the form shown, the first coupling portion 14 on each of the front and rear surfaces 11, 12 of the hanger body 1 is a rectilinear rib including upper and rear faces each having a concave retaining groove 141. The hanger body 1 further includes a plurality of spaced first positioning portions 15 in the form shown as protrusions. Some of the protrusions 15 are located above the first coupling portion 14, and the remaining of the protrusions 15 are located below the first coupling portion 14.

The displayable tool receiving device further includes a plurality of tool receiving boxes, such as bit receiving boxes 2 each having a bit receiving section 26 for receiving a screwdriver bit 4 and adapter receiving boxes 3 each having an adapter receiving section 35 for receiving an adapter 5. Each of the bit receiving boxes 2 and the adapter receiving boxes 3 includes a rear side having a rectilinear second coupling portion 21, 31. In the form shown, the second coupling portion 21, 31 of each of the bit receiving boxes 2 and the adapter receiving boxes 3 is a rectilinear engagement groove having a width corresponding to a width of the concave retaining groove 141. Each of the engagement grooves includes upper and lower retaining edges 211, 311. The rear side of each of the bit receiving boxes 2 and the adapter receiving boxes 3 further includes a second positioning portion 22, 32 in the form shown as a positioning groove intersecting the engagement groove.

One or more of the bit receiving boxes 2 and the adapter receiving boxes 3 can be optionally mounted to the hanger body 1. In the example shown in FIGS. 3 and 4, three bit receiving boxes 2 are mounted to the front surface 11 of the hanger body 1, and three adapter receiving boxes 3 are mounted to the rear surface 12 of the hanger body 1. The second coupling portion 21, 31 of each of the bit receiving boxes 2 and the adapter receiving boxes 3 is engaged with the first coupling portion 14 of the hanger body 1. The bit receiving boxes 2 and the adapter receiving boxes 3 are then moved until the second positioning portion 22, 32 of each of the bit receiving boxes 2 and the adapter receiving boxes 3 is engaged with one of the first positioning portions 15 of the hanger body 1. Specifically, the upper and lower retaining edges 211, 311 of each of the bit receiving boxes 2 and the adapter receiving boxes 3 are engaged with the concave retaining grooves 141 of the rib on one of the front and rear surfaces 11 and 12 of the hanger body 1, providing a double positioning effect. The rear sides of the bit receiving boxes 2 and the adapter receiving boxes 3 abut the front and rear surfaces 11 and 12 of the hanger body 1, providing enhanced assembling reliability. Thus, the bit receiving boxes 2 and the adapter receiving boxes 3 will not swing after assembly.

Figure 5:
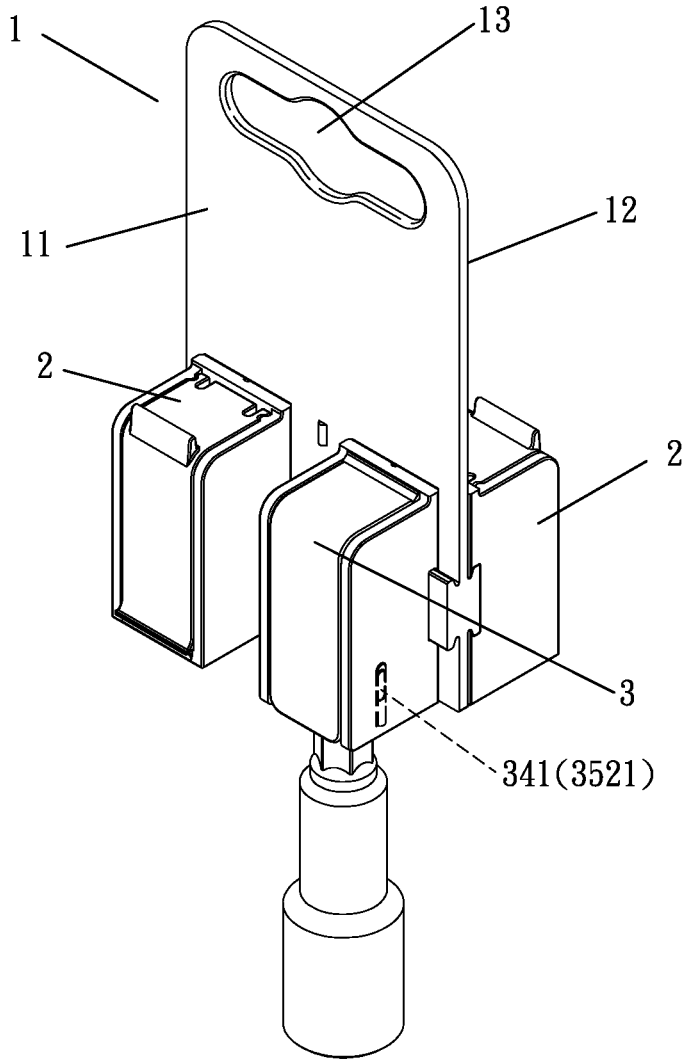
FIG. 5 shows another example of use of the tool receiving device according to the present invention.

In another example shown in FIG. 5, a bit receiving box 2 and an adapter receiving box 3 are mounted to the front surface 11 of the hanger body 1. Another bit receiving box 2 and another adapter receiving box 3 are mounted to the rear surface 12 of the hanger body 1. However, other arrangements can be done to meet different needs.

With reference to FIGS. 1-4 and 6, each bit receiving box 2 includes a rear board 23, two side boards 24, a bottom board 25, and the bit receiving section 26. The second coupling portion 21 is located on the rear board 23. The side boards 24 extend perpendicularly from two lateral edges of the rear board 23. The side boards 24 and the rear board 23 define a compartment 28. Each side board 24 includes a front end and a top end. A first snapping portion 241 is provided on a rear end of an inner wall of each side board 24. In the form shown, the first snapping portion 241 on the rear end of the inner wall of each of the side boards 24 is a ridge, and a snapping groove 243 is defined between each of the ridges and the rear board 23. The bottom board 25 is connected to a lower end of the rear board 23 and to a lower end of each side board 24. The bottom board 25 includes a front end connected to a bottom edge of the bit receiving section 26 by a thin connecting section 251. Due to provision of the thin connecting section 251, the bit receiving section 26 is pivotable relative to the bottom board 25 between a storage position received in the compartment 28 and a display position outside of the compartment 28. The bit receiving section 26 includes a front board 261, a top board 262, and a clamping section 263. The front board 261 has a width substantially equal to a spacing between the front ends of the two side boards 24. The front board 261 covers a front opening defined between the front ends of the side boards 24 when the bit receiving section 26 in the storage position. A gripping section 2611 is formed on a top face of the top board 262. The top board 262 extends perpendicularly to a top end of the front board 261 and has a width corresponding to a spacing between the top ends of the side boards 24. The top board 262 covers the top ends of the side boards 24 when the bit receiving section 26 is in the storage position. The top board 262 includes a second snapping portion 2621 on a rear end thereof. In the form shown, the second snapping portion 2621 includes two lugs releasably engaged in the snapping grooves 243. Each of the lugs includes a recessed portion to provide a space for deformation of the lug. The second snapping portion 2621 is engaged with the first snapping portion 242 when the bit receiving section 26 is in the storage position. The clamping section 263 extends from an inner wall of the top board 262 and includes two flexible clamping pieces 2632 defining a clamping space 2632. The bit 4 is adapted to be held in the clamping space 2632.

Figure 6:
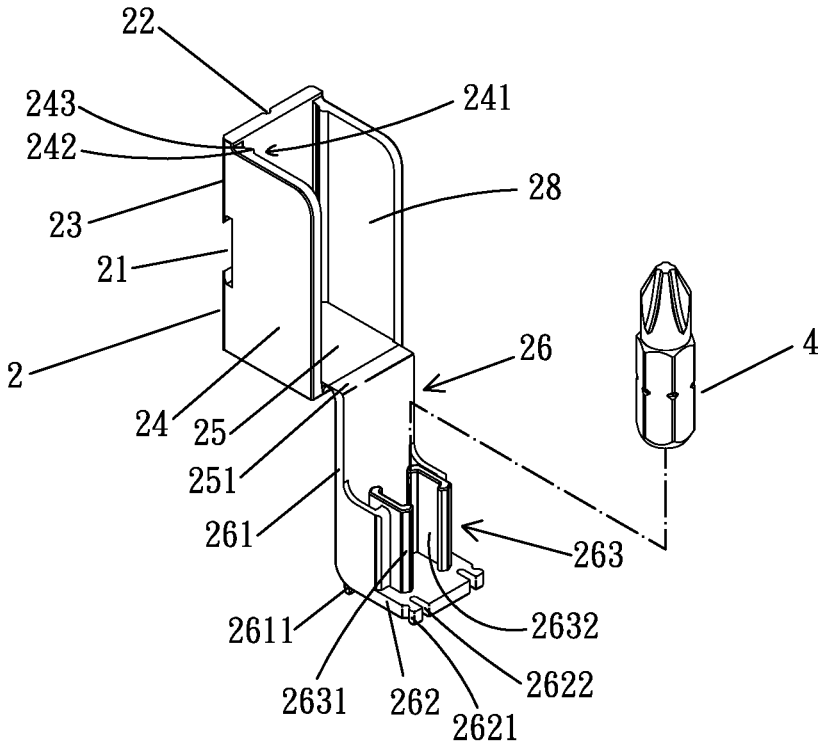
FIG. 6 shows a perspective view of a bit receiving box of the tool receiving device according to the present invention and a bit.

The bit receiving section 26 can be moved to the display position shown in FIG. 6, and the bit 4 can be received in the clamping space 2632 and securely held by the flexible clamping pieces 2632. On the other hand, the bit receiving section 26 can be pivoted to the storage position received in the compartment 28 defined between the side boards 24, the rear board 23, and the bottom board 25. Thus, the bit 4 can be completely covered to avoid dust and moisture, providing enhanced protecting effect. Note that the lugs of the second snapping portion 2621 of the bit receiving section 26 are engaged in the snapping grooves 243 of the first snapping portions 241 of the side boards 24.

Figure 9:
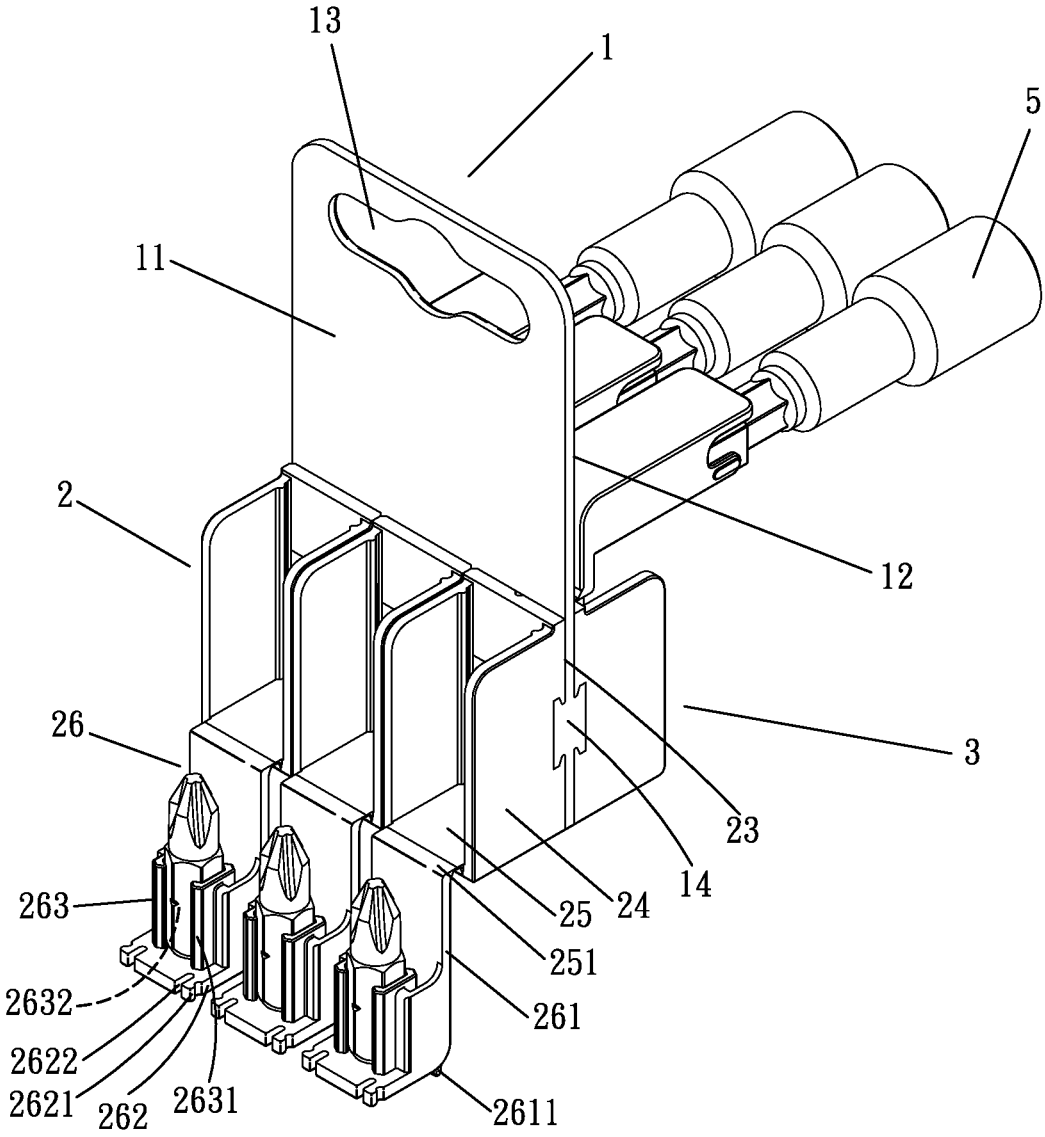
FIG. 9 shows a perspective view of the tool receiving device according to the present invention, with each of the bit receiving boxes and the adapter receiving boxes in a display position for displaying the bits and the adapters.

With reference to FIG. 9, a user can grip the gripping section 2611 and pivot the bit receiving section 26 to the display position. The front board 261 of the bit receiving section 26 pivots downward to a location under the action of the weight of the bit 4, in which location the front board 261 extends in a direction parallel to the rear bard 23. The inner wall of the top board 262 can support an end of the bit 4 while allowing easy removal of the bit 4.

With reference to FIGS. 1-4 and 7, each adapter receiving box 3 includes a rear plate 33, two side plates 34, and an adapter receiving section 35. The adapter 5 includes an operative first end 51 and a second end 52. In the form shown, the first end 51 is in the form of a socket. However, the first end 51 can be of other forms and shapes, such as a bit. The second end 52 of the adapter 5 includes an annular groove 521. The second coupling portion 31 is located on the rear plate 33. The rear plate 33 of the adapter receiving box 3 includes an inner wall having a projection 331. The projection 331 is adapted to abut the second end 52 of the adapter 5. The inner wall of the rear plate 33 further includes a protrusion 332 that can be received in the annular groove 521 of the adapter 5. The side plates 34 extend perpendicularly from two lateral edges of the rear plate 33. A first snapping section 341 in the form shown as a snapping groove is formed in a lower end of an inner wall of each side plate 34. The adapter receiving section 35 includes a top plate 351, a front plate 352, and a clamping portion 353. The rear end of the top plate 351 of the adapter receiving box 3 is connected by a thin connecting section 3511 to the top end of the rear plate 33. Due to provision of the thin connecting section 3511, the adapter receiving section 35 is pivotable relative to the rear plate 33 between a storage position and a display position. The front plate 352 extends perpendicularly from a front end of the top plate 351. The front plate 352 has a width corresponding to a spacing between front ends of the side plates 34. The front plate 352 covers a front opening defined between the front ends of the side plates 34 when the adapter receiving section 35 is in the storage position. Two fence plates 3521 extend perpendicularly from two lateral edge of the front plate 352. A second snapping section 3522 in the form of a bulge is formed on each fence plate 3521. Each bulge is releasably engaged with the snapping groove of one of the first snapping sections 341. The clamping portion 353 includes two flexible clamping pieces 3531 located between the fence plates 3521 and defining a clamping space 3532. The adapter 5 is adapted to be held in the clamping space 3532.

Figure 7:
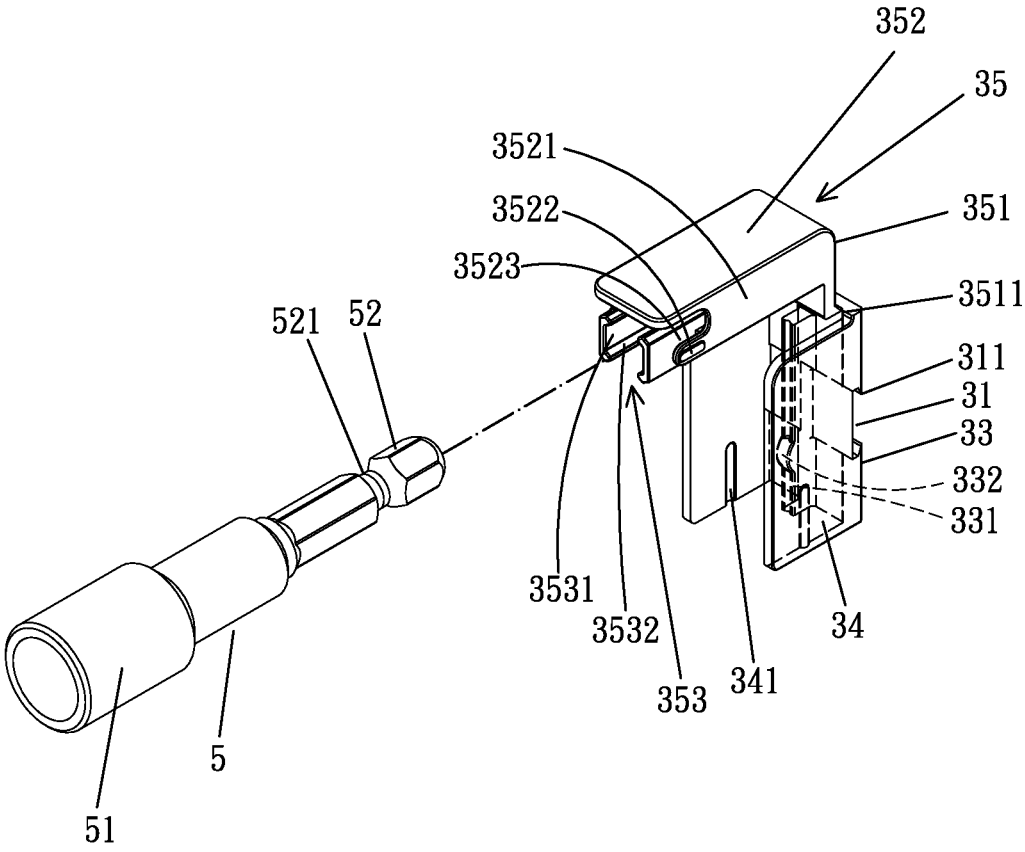
FIG. 7 shows a perspective view of an adapter receiving box of the tool receiving device according to the present invention and an adapter.
Figure 10:
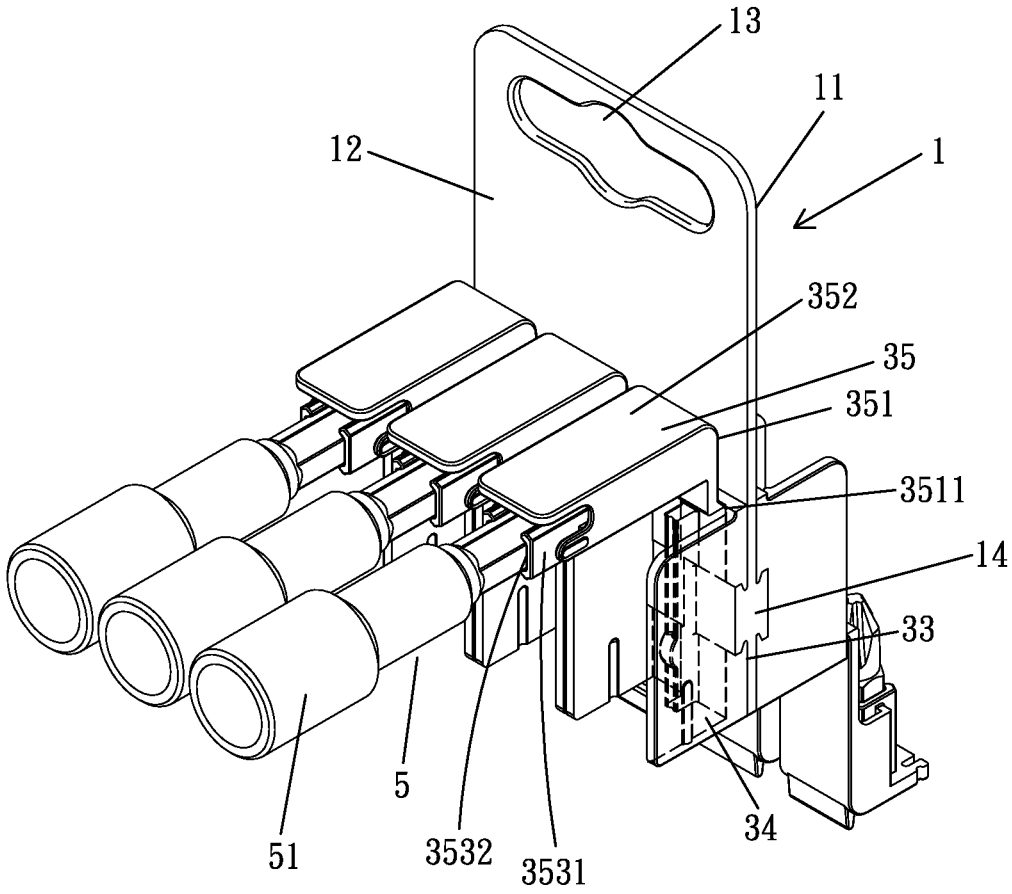
FIG. 10 shows another perspective view of the tool receiving device of FIG. 9.

With reference to FIGS. 7 and 10, the adapter receiving section 35 can be pivoted relative to the rear plate 33 to the display position in which the clamping space 3532 extends perpendicular to the rear plate 33. The second end 52 of the adapter 5 is received in the clamping space 3532 and securely held by the flexible clamping pieces 3531.

Figure 3:
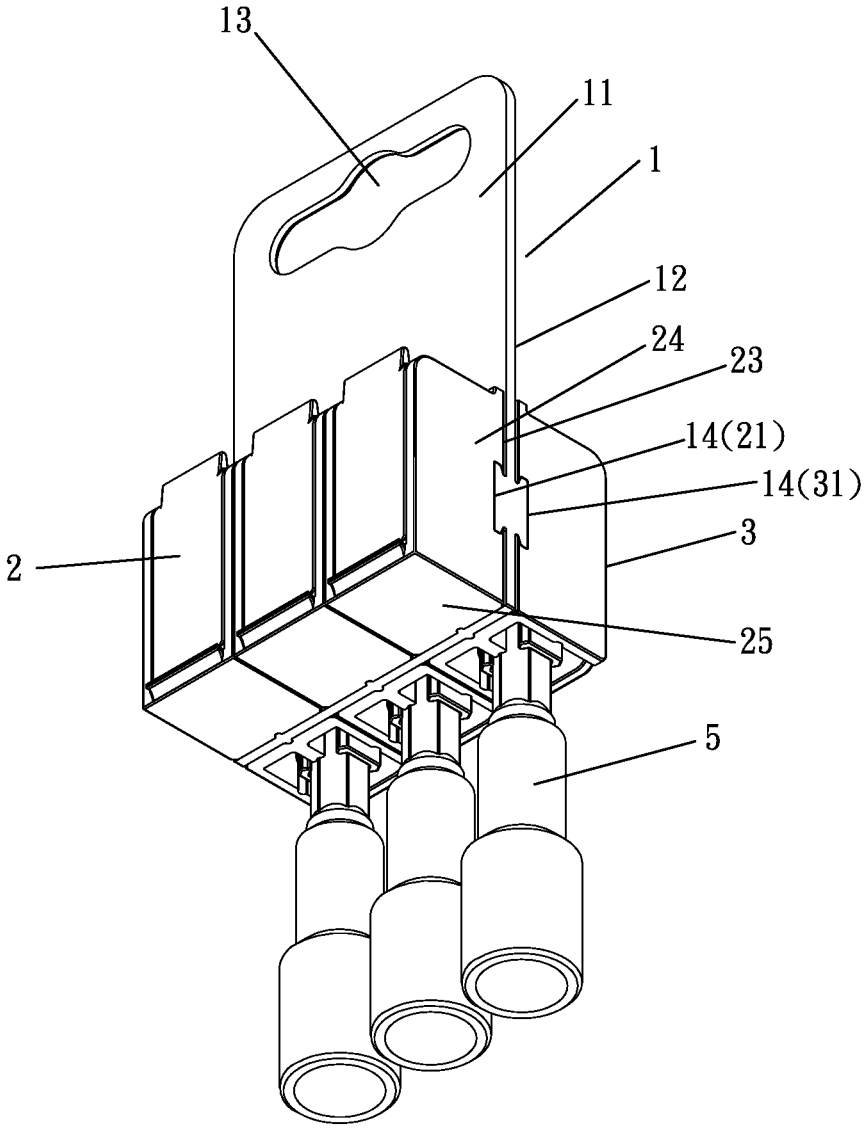
FIG. 3 shows a perspective view of the tool receiving device of FIG. 1, with the tools in a storage position.
Figure 4:
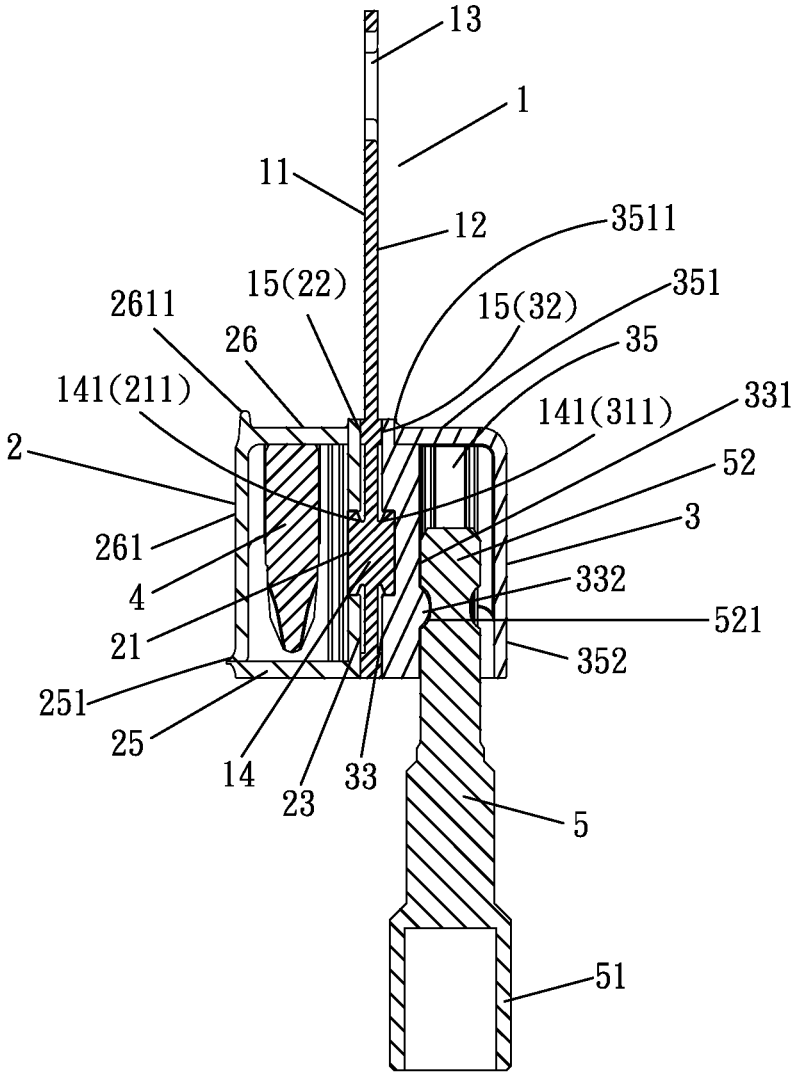
FIG. 4 shows a cross sectional view of the tool receiving device of FIG. 3.
Figure 8:
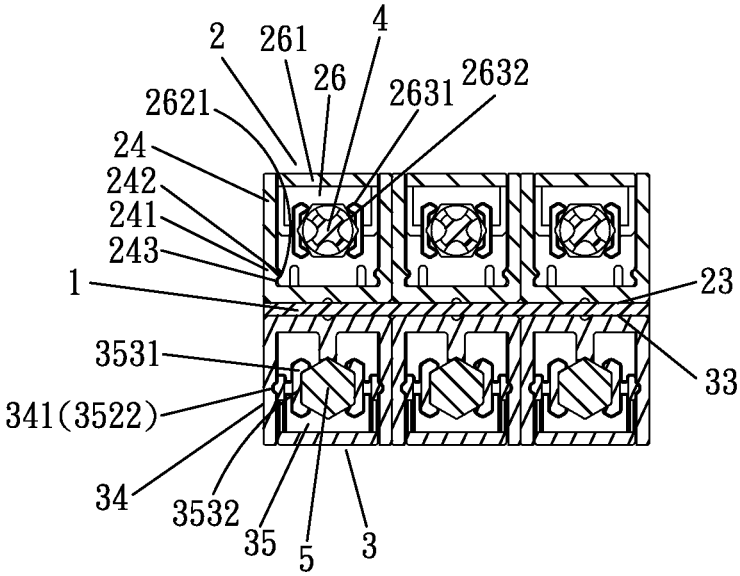
FIG. 8 shows a cross sectional view of the tool receiving device according to the present invention, with the bits and the adapters in a storage position.

With reference to FIGS. 3, 4, and 8, the adapter receiving section 35 can be pivoted downward relative to the rear plate 33 to the storage position and received in a space defined by the side plates 34 and the rear plate 33. The second snapping sections 3522 of the fence plates 3521 are engaged with the first snapping sections 341 of the side plates 34. Furthermore, the second end 52 of the adapter 52 abuts the projection 331 of the rear plate 33, providing enhanced positioning effect. Furthermore, the annular groove 521 of the adapter 5 receives the protrusion 332 of the rear plate 33, preventing the adapter 5 from falling and, hence, providing enhanced assembling reliability. The shape of the first end 51 of the adapter 5 can directly be seen to provide enhanced display effect as well as convenient use.

By providing the modular receiving boxes 2 and 3 for receiving the bits 4 and the adapters 5, the displayable tool receiving device according to the present invention provides enhanced utility, enhanced assembling reliability, and convenient display.

It can be appreciated that the first and second coupling portions 14 and 15 can be located in a vertical direction of the hanger body 1, instead of the transverse direction of the hanger body 1 shown in the drawings.

Although specific embodiments have been illustrated and described, numerous modifications and variations are still possible without departing from the essence of the invention. The scope of the invention is limited by the accompanying claims.

The invention claimed is:

1. A displayable tool receiving device comprising:

a hanger body including a hanger hole, a rectilinear first coupling portion covering a section of the hanger body, and two groups of spaced first positioning portions, wherein a 1st group and a 2nd group of the two groups of spaced first positioning portions symmetrically located with respect to the rectilinear first coupling portion;

tool receiving boxes each including a rear side having a rectilinear second coupling portion, the rear side of each of the tool receiving boxes further including a second positioning portion, each of the tool receiving boxes capable of being mounted to the hanger body, and not each of the tool receiving boxes required to be mounted to the hanger body in actual use;

the second coupling portion of each of the tool receiving boxes engaged with the first coupling portion of the hanger body, the second positioning portion of each of the tool receiving boxes engaged with one of the first positioning portions of the hanger body, and the hanger body including a front surface and a rear surface, and the first coupling portion provided on each of the front and rear surfaces of the hanger body.

2. The displayable tool receiving device as claimed in claim 1, with the first coupling portion on each of the front and rear surfaces of the hanger body being a rectilinear rib including upper and rear faces each having a concave retaining groove, the first positioning portions being protrusions, some of the protrusions located above the first coupling portion, a remaining of the protrusions located below the first coupling portion, the second coupling portion of each of the tool receiving boxes being a rectilinear engagement groove having a width corresponding to a width of the concave retaining groove, each of the engagement grooves including upper and lower retaining edges, the upper and lower retaining edges of each of the at least one of the tool receiving boxes engaged with the concave retaining grooves of the rib on one of the front and rear surfaces of the hanger body, the second positioning portion of each of the tool receiving boxes being a positioning groove, the positioning groove of each of the at least one of the tool receiving boxes engaged with one of the protrusions of the hanger body.

3. The displayable tool receiving device as claimed in claim 2, with the plurality of tool receiving boxes including a bit receiving box and an adapter receiving box, the bit receiving box adapted to receive a screwdriver bit, and the adapter receiving box adapted to receive an adapter.

4. The displayable tool receiving device as claimed in claim 3, with the bit receiving box including a rear board, two side boards, a bottom board, and a bit receiving section, the second coupling portion located on the rear board, the two side boards extending perpendicularly from two lateral edges of the rear board, the two side boards and the rear board defining a compartment, with each of the two side boards including a front end and a top end, a first snapping portion provided on a rear end of an inner wall of each of the two side boards, the bottom board connected to a lower end of the rear board and to a lower end of each of the two side boards, the bottom board including a front end connected to a bottom edge of the bit receiving section, the bit receiving section pivotable relative to the bottom board between a storage position received in the compartment and a display position outside of the compartment, the bit receiving section including a front board, a top board, and a clamping section, the front board having a width substantially equal to a spacing between the front ends of the two side boards, the front board covering a front opening defined between the front ends of the two side boards when the bit receiving section in the storage position, the top board extending perpendicularly to a top end of the front board and having a width corresponding to a spacing between top ends of the two side boards, the top board covering the top ends of the two side boards when the bit receiving section is in the storage position, the top board including a second snapping portion on a rear end thereof, the second snapping portion engaged with the first snapping portion when the bit receiving section is in the storage position, the clamping section extending from an inner wall of the top board and including two flexible clamping pieces, the two flexible clamping pieces defining a clamping space, and a bit adapted to be held in the clamping space.

5. The displayable tool receiving device as claimed in claim 4, with the first snapping portion on the rear end of the inner wall of each of the two side boards being a ridge, a snapping groove defined between each of the ridges and the rear board, the second snapping portion including two lugs releasably engaged in the snapping grooves, and each of the two lugs including a recessed portion to provide a space for deformation of the lug.

6. The displayable tool receiving device as claimed in claim 5, the front end of the bottom board connected to the bottom edge of the bit receiving section by a thin connecting section, the thin connecting section allowing the bottom board to pivot relative to the bit receiving section, and a gripping section formed on a top face of the top board.

7. The displayable tool receiving device as claimed in claim 3, with an adapter including an operative first end and a second end, the second end of the adapter including an annular groove, the adapter receiving box including a rear plate, two side plates, and an adapter receiving section, the second coupling portion located on the rear plate, the rear plate including an inner wall having a protrusion, the two side plates extending perpendicularly from two lateral edges of the rear plate, a first snapping section formed on a lower end of an inner wall of each of the two side plates, the adapter receiving section pivotable relative to the rear plate between a storage position and a display position, the adapter receiving section including a top plate, a front plate, and a clamping portion, the front plate extending perpendicularly from a front end of the top plate, the front plate including a width corresponding to a spacing between front ends of the two side plates, the front plate covering a front opening defined between the front ends of the two side plates when the adapter receiving section is in the storage position, two fence plates extending perpendicularly from two lateral edge of the front plate, a second snapping section formed on each of the two fence plates, the clamping portion including two flexible clamping pieces, with the two flexible clamping pieces located between the two fence plates and defining a clamping space, the adapter adapted to be held in the clamping space, wherein with the adapter receiving section in the storage position, the adapter receiving section is received in a space defined by the two side plates and the rear plate, the second snapping sections of the two fence plates are engaged with the first snapping sections of the two side plates, the annular groove of the adapter receives the protrusion of the rear plate.

8. The displayable tool receiving device as claimed in claim 7, with the rear plate of the adapter receiving box including an inner wall having a projection, the projection adapted to abut the second end of the adapter, with each of the first snapping sections including a snapping groove, and each of the second snapping sections including a bulge releasably engaged with the snapping groove of one of the first snapping sections.

9. The displayable tool receiving device as claimed in claim 8, with a rear end of the top plate of the adapter receiving box is connected by a thin connecting section to a top end of the rear plate.

* * * * *